United States Patent [19]

Sando et al.

[11] Patent Number: 4,484,460

[45] Date of Patent: Nov. 27, 1984

[54] APPARATUS FOR WET-HEAT TREATING A CLOTH CONTINUOUSLY

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 514,142

[22] Filed: Jul. 14, 1983

[30] Foreign Application Priority Data

Jul. 16, 1982 [JP] Japan ..... 57-123817
Jul. 16, 1982 [JP] Japan ..... 57-123818

[51] Int. Cl.[3] ..... D06B 3/12; D06B 23/00

[52] U.S. Cl. ..... 68/5 E; 68/62; 68/205 R; 165/140

[58] Field of Search ..... 68/5 D, 5 E, 62, 205 R, 68/207; 165/140

[56] References Cited

U.S. PATENT DOCUMENTS 2,351,701 6/1944 Perkins ..... 68/205 R X
2,441,991 5/1948 Converse et al. ..... 68/5 E
2,532,471 12/1950 Wedler ..... 68/5 D
3,041,863 7/1962 Goto ..... 68/5 E
3,131,840 5/1964 Berger et al. ..... 68/205 R X
4,142,854 3/1979 Sando et al. ..... 68/5 E X

FOREIGN PATENT DOCUMENTS 643241 7/1962 Italy ..... 68/5 D

*Primary Examiner*—Philip R. Coe
*Attorney, Agent, or Firm*—Wenderoth, Lind & Ponack

[57] ABSTRACT

An apparatus for wet-heat treating a cloth continuously, comprising a high temperature liquid generating chamber maintained at a constant high temperature and pressure by supplying high temperature and pressure steam therein and provided with a treating solution heating pipe and a water heating pipe, and a wet-heat chamber provided with a plurality of guide rollers for transporting a cloth to be treated zigzag forming snaky undulations through the chamber and a plurality of nozzle pairs respectively arranged adjacent to both sides of the cloth and communicating to the treating solution heating pipe and/or the water heating pipe.

4 Claims, 5 Drawing Figures

APPARATUS FOR WET-HEAT TREATING A CLOTH CONTINUOUSLY

BACKGROUND OF THE INVENTION

The present invention relates to an apparatus for wet-heat treating a cloth at a temperature above 100° C. continuously.

For subjecting a long cloth to such treatments as scouring, bleaching, dyeing, resin finishing and weight reducing continuously, such means as an ordinary atmospheric pressure treating method which is carried out at the ordinary atmospheric pressure and a high pressure treating method which is done at an elevated pressure higher than the ordinary atmospheric pressure have usually been adopted. However, the former ordinary pressure treating method requires a long time at a temperature below 100° C. until the treatment is completed, thus lacking of high productivity and furthermore, the quality of the product is not satisfactory. Therefore, the latter high pressure method, in which the treatment can be done speedily at a high temperature and the quality of the product is excellent, is widely adopted at the present time.

This high pressure treating method allows continuous wet-heat treatment of a cloth under high temperature and high humidity by using a steamer can or reactor which can hold high temperature and high humidity, while permitting continuous feeding of the cloth therethrough. By effecting wet-heat treatment under high temperature and high humidity, a treating agent is caused to react with the cloth whereby a desired processing, such as scouring, bleaching, dyeing, resin finishing, weight reducing or the like, can be effected continuously at high speed. In such wet-heat treatment under high temperature and high humidity, however, it is necessary to hold the atmosphere within the steamer can at high temperature and at high humidity, preparatory to starting the wet-heat treatment, and consequently it requires relatively long time until the atmosphere within the steamer can attains a predetermined high level of temperature and humidity. Accordingly, this treatment requires relatively long readiness time before actually starting the cloth treating operation and furthermore, it requires a large amount of thermal energy to attain the predetermined high temperature and high humidity of the atmosphere within the steamer can.

In the case where a pair of seal mechanisms are provided at the cloth inlet and outlet of the steamer can for maintaining the interior of the steamer can to a high temperature and high humidity atmosphere while allowing the taking in and out of a cloth continuously therethrough, the construction of the whole apparatus becomes complicated and particularly the construction cost becomes unavoidably very high in a large size apparatus.

Furthermore, in the conventional wet-heat treating methods, while a cloth is soaked with a treating solution at a position outside of the steamer can by passing the cloth through a treating solution tank, the resultant cloth must be squeezed with the use of squeeze rollers for removing the excess of the treating solution in introducing the cloth in the steamer can, thereby causing the problem of the unevenness in squeezing. In other words, the width of a commercial cloth is at least more than 90 cm, and it requires a squeeze roller with a length at least with the width of the cloth for squeezing such a broad cloth continuously. In such a long squeeze roller, the squeezing pressure differs at the central part and the two end parts of the roller, causing the unevenness in squeezing the treating solution from the cloth and consequently the unevenness in treatment. In dyeing, particularly, the occurrence of dye speck caused to occur due to the unevenness in squeezing is a serious problem.

SUMMARY OF THE INVENTION

Under such circumstances, the object of the present invention is to offer an apparatus having a simplified structure for wet-heat treating a long cloth continuously.

The principle of the present inventive apparatus comprises providing a high temperature liquid generating chamber having a treating solution heating pipe and a water heating pipe, and a wet-heat chamber having a plurality of nozzle pairs arranged adjacent to both sides of a cloth to be treated and communicating to the treating solution heating pipe and/or the water heating pipe.

The present inventive apparatus is simple in its structure without using an airtightly sealed high pressure steamer can and preventing the heat energy loss, and thus performing the treatment of a cloth such as scouring, bleaching, dyeing and resin finishing under wet-heat at a temperature higher than 100° C. continuously and quite economically.

BRIEF DESCRIPTION OF THE DRAWINGS

The drawings are to show the examples of the present inventive apparatus for wet-heat treating a cloth continuously.

DETAILED DESCRIPTION OF THE PREFERRED EMBODIMENTS

Figure 1:
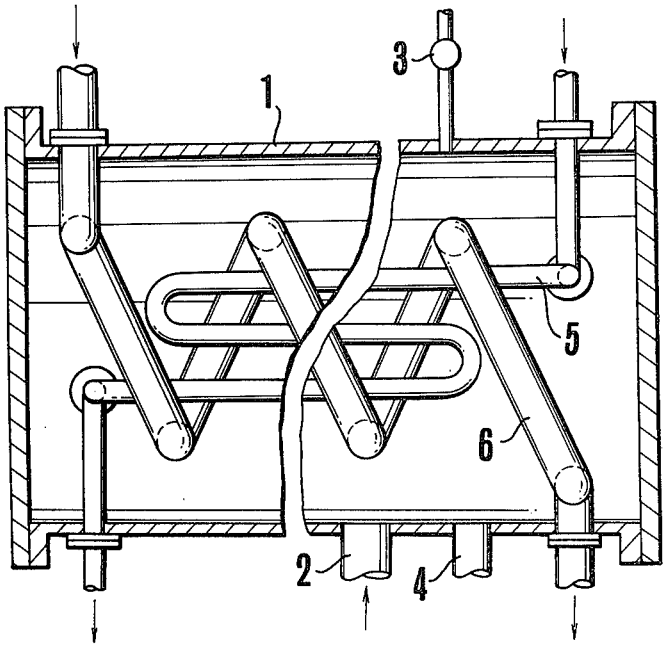
FIG. 1 is a partially cutting front view of a high temperature liquid generating chamber.

Preferred embodiments of the present invention will be described in detail in the following by referring to the drawings showing the examples of the inventive apparatus.

Figure 2:
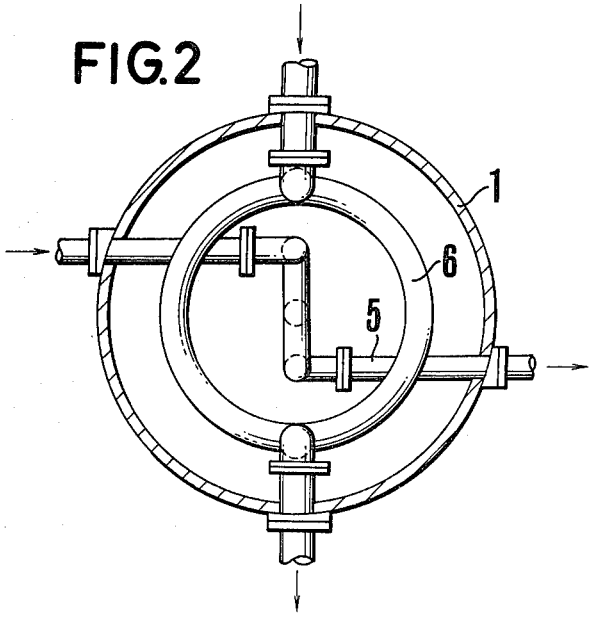
FIG. 2 shows its longitudinal section.
Figure 3:
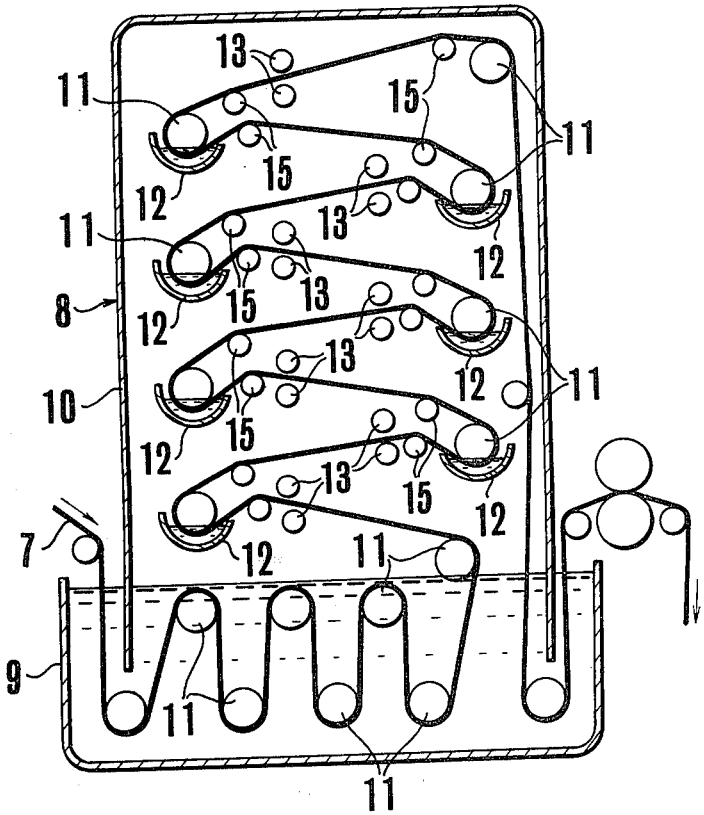
FIG. 3 is an explanatory drawing of an example of the wet-heat chamber.

In FIG. 1, 1 is a high temperature liquid generating chamber, which comprises a steam supply pipe 2 for supplying high temperature and pressure steam to the chamber, an inner pressure automatic control valve 3 for maintaining the vapor pressure in the chamber always constant, and a liquid discharge pipe 4 for discharging water condensed in the chamber in case of need. 5 is a treating solution heating pipe and 6 is a water heating pipe, both being provided in the high temperature liquid generating chamber forming snaky undulations as shown in FIGS. 1 and 2 so as to pass the treating solution and water supplied from the chamber 1 respectively therethrough into a plurality of nozzle pairs 13 in a wet-heat chamber 8 as will be shown in FIG. 3.

The shapes of the heating pipes 5 and 6 are not limited to this example. The shape may be optional so long as the pipes can easily receive the heat in the chamber 1.

The pipes may have many wings for increasing heat conductivity. In this example, a treating solution heating pipe 5 and a water heating pipe 6 are provided for the purpose of obtaining a heated treating solution and heated water simultaneously, but one of the pipes 5 and 6 may be omitted under circumstances.

In FIG. 3, 7 is a cloth to be treated (for instance, desizing and hot water washing) and 8 is a wet-heat chamber for wet heat treating a cloth continuously. It is designed so that wet-heat treatment of a cloth with a desired treating solution is completed during the cloth is passing through the wet-heat chamber 8. The wet-heat chamber 8 comprises a liquid tank 9, whose upper surface is opened, and a vertical chamber 10, whose lower opening is immersed in the liquid tank 9 to maintaining the interior thereof airtight. A plurality of guide rollers 11 are provided in the liquid tank 9 and the vertical chamber 10 for transporting the cloth 7 zigzag forming snaky undulations through the wet-heat chamber 8, and a liquid saucer 12 is provided respectively for each of the lower side of the guide rollers 11 and the vertical chamber 10.

Figure 4:
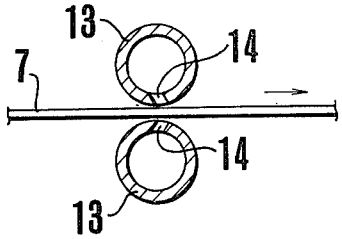
FIG. 4 is an enlarged sectional view of a pair of nozzles provided in the wet-heat chamber.

13 are a plurality of nozzle pairs respectively provided in the vertical chamber 10 by putting the cloth closely therebetween so as to jet a hot liquid (for instance, a hot treating solution and/or hot water heated to a temperature above 100° C. in the high temperature generating chamber 1) to the cloth passing through the guide rollers 11. As shown in FIG. 4, the liquid jet opening 14 of each of the nozzle pairs 13 is inclined to the passing direction of the cloth 7. The nozzles are connected to the treating solution heating pipe 5 and/or the water heating pipe 6 so as to jet a heated treating solution or heated hot water selectively. 15 are auxiliary guide rollers for expanding the cloth between the two guide rollers 11.

The construction of an example of the present inventive apparatus is as mentioned above. Now, its function will be described in the following.

In supplying pressured steam from the steam supply pipe 2 into the high temperature liquid generating chamber 1 for saturating the chamber with steam, for instance, at a pressure of 5 kg/cm$^2$, the interior of the chamber 1 is maintained at a temperature about 150° C. under pressure, and accordingly the treating solution heating pipe 5 and the water heating pipe 6 are heated up to about 150° C. in the chamber 1. In passing a treating solution and water respectively through the treating solution heating pipe 5 and the water heating pipe 6 under pressure, the treating solution and water in these pipes are heated up to nearly 150° C. Under circumstances, only the treating solution heating pipe 5 or the water heating pipe 6 may be employed.

The heated treating solution or hot water (hereinafter will be simply called heated liquid) thus heated to a high temperature is jetted through each of the nozzles 13 provided in the wet-heat chamber 8 onto a cloth 7 to be treated for applying the heated liquid to the cloth. Whereas the temperature of the heated liquid is lowered suddenly in jetting the heated liquid through the nozzles 13 into the wet-heat chamber 8 under the ordinary pressure, since the distance between the nozzles and the cloth can be narrowed sufficiently, it is possible to apply a heated liquid to the cloth to be treated at a temperature higher than 100° C., and thus a high temperature heated liquid treatment of a cloth can effectively be done under the ordinary pressure. Under circumstances, the treatment of a cloth with a treating solution is done with the use of the nozzles in the former half step and washing of the cloth thus treated is done with the use of the nozzles at the latter half step.

In this example, the nozzles 13 are provided in pairs adjacent to both sides of the cloth and the heated liquid is jetted through the liquid jet openings 14 at an elevated temperature, so that the heated liquid is penetrated up to the core part of the cloth sufficiently and thus an effective wet-heat treatment can be done. Since heated liquid is applied to the cloth by means of nozzles, its amount can easily be controlled, and thus excessive consumption of the treating solution can be prevented. Furthermore, since the liquid jet openings 14 of the nozzles 13 are inclined to the passing direction of the cloth 7, the jetting force of the heated liquid jetted through the nozzles 13 accelerates the smooth transfer of the cloth in the wet-heat chamber 8.

Figure 5:
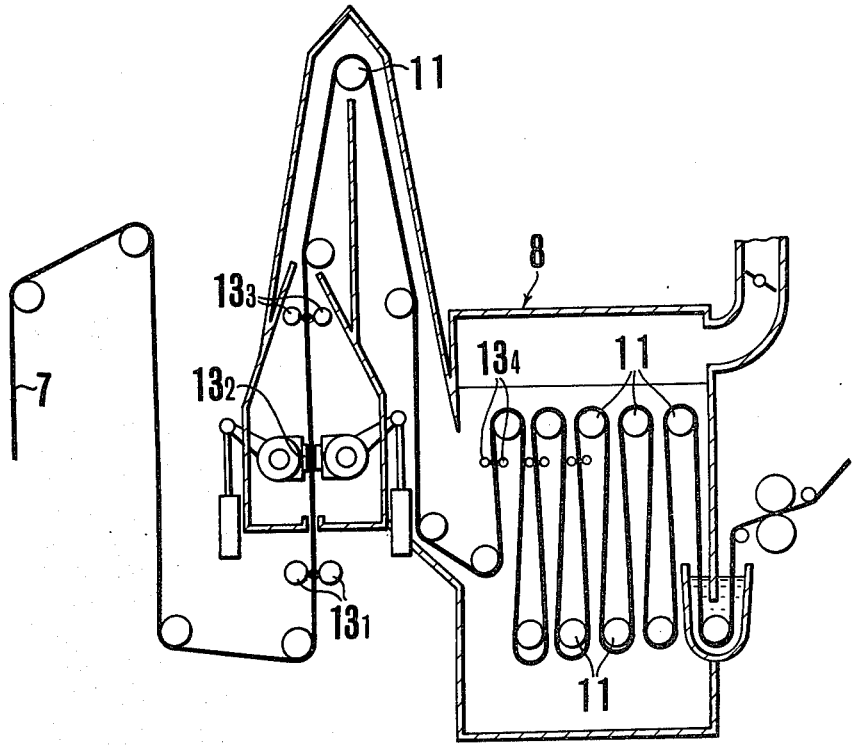
FIG. 5 is an explanatory drawing showing another example of the wet-heat chamber including a pair of nozzles provided outside the wet-heat chamber.

FIG. 5 is to show another example of the wet-heat chamber in the present invention, to which a pair of nozzles are provided at a position adjacent to the inlet of the wet-heat chamber. In FIG. 5, $\mathbf{13}_1$, $\mathbf{13}_2$, $\mathbf{13}_3$ and $\mathbf{13}_4$ are respectively the nozzle pairs by putting the cloth therebetween, among which $\mathbf{13}_1$ being the ones provided outside the wet-heat chamber. Other symbols in FIG. 5 are to show the same members as in FIG. 3.

In this example, the treating solution can be applied to the cloth outside of the wet-heat chamber. Since the wet-heat chamber is not sealed under pressure, there is no need of squeezing the cloth in introducing the cloth in the chamber. As mentioned above, the hot liquid is applied to the cloth by means of nozzles, so that excessive consumption of the treating solution can be prevented in the present invention. However, a certain extent of loss of the treating solution cannot be avoidable due to dropping of the solution from the cloth. This example of the apparatus is beneficial for preventing the loss of the treating solution because the recovery of the solution can easily be done outside the wet-heat chamber. Therefore, this type of the example is suitable in applying a costly treating agent such as in the case of dyeing.

The construction and function of the present inventive apparatus for wet-heat treating a cloth continuously are as mentioned above. In the present invention, a treating solution and water are heated up to 100° C. by using a high temperature liquid generating chamber 1, and thus heated liquid is jetted to a cloth to be treated in a wet-heat chamber 8.

Accordingly, in the present invention, the treatment of a cloth, which has conventionally been done under the wet-heat in a reactor maintained with a high temperature and humidity atmosphere in a high pressure steamer, can be done quite easily and effectively using a simple apparatus. Furthermore, the temperature of the liquid passing through the treating solution and water heating pipes can be made constant by maintaining the temperature of the interior of the high temperature liquid generating chamber constant, and thus uniform treatment of a long cloth can be done continuously to give an excellent product in the present invention.

What we claim:

1. An apparatus for wet-heat treating a cloth continuously, comprising a high temperature liquid generating chamber maintained at a constant high temperature and pressure by supplying high temperature and pressure steam therein and provided with at least one of a treating solution heating pipe and a water heating pipe, and a wet-heat chamber provided with a plurality of guide rollers for transporting a cloth to be treated zigzag forming snaky undulations through the chamber and a plurality of nozzle pairs respectively arranged adjacent to both sides of the cloth and communicating to said treating solution heating pipe and/or the water heating pipe.

2. An apparatus for wet-heat treating a cloth continuously according to claim 1, in which a pair of nozzles are provided adjacent to the entrance of the cloth to the wet-heat chamber for applying a treating solution to the cloth before the cloth is introduced into the wet-heat chamber.

3. An apparatus for wet-heat treating a cloth continuously according to claim 1, in which the liquid jet opening of each of the nozzle pairs is inclined to the passing direction of the cloth for accelerating the smooth transfer of the cloth.

4. An apparatus for wet-heat treating a cloth continuously according to claim 2, in which the liquid jet opening of each of the nozzle pairs is inclined to the passing direction of the cloth for accelerating the smooth transfer of the cloth.

* * * * *